US010518933B2

(12) United States Patent
Dorn

(10) Patent No.: US 10,518,933 B2
(45) Date of Patent: Dec. 31, 2019

(54) STACKABLE PLASTIC CONTAINER

(75) Inventor: James Christopher Dorn, Sterling, OH (US)

(73) Assignee: Plastipak Packaging, Inc., Plymouth, MI (US)

( * ) Notice: Subject to any disclaimer, the term of this patent is extended or adjusted under 35 U.S.C. 154(b) by 0 days.

(21) Appl. No.: 13/030,313

(22) Filed: Feb. 18, 2011

(65) Prior Publication Data

US 2011/0132790 A1 Jun. 9, 2011

Related U.S. Application Data

(63) Continuation-in-part of application No. 12/855,902, filed on Aug. 13, 2010, now Pat. No. 9,352,873, and a continuation-in-part of application No. 29/360,887, filed on May 3, 2010, now Pat. No. Des. 635,460, said application No. 12/855,902 is a continuation-in-part (Continued)

(51) Int. Cl.
*B65D 21/02* (2006.01)

(52) U.S. Cl.
CPC ..... *B65D 21/0231* (2013.01)

(58) Field of Classification Search
CPC ..... B65D 21/0231; B65D 21/0202; B65D 21/0204; B65D 21/0237; A47G 19/23
USPC ..... 215/10, 371, 375, 382; 206/217, 218, 206/219, 221, 222, 361, 427, 508, 509, (Continued)

(56) References Cited

U.S. PATENT DOCUMENTS 3,301,293 A * 1/1967 Santelli ..... 220/666
3,369,688 A * 2/1968 Dike ..... B65D 21/0231 215/10

(Continued)

FOREIGN PATENT DOCUMENTS

EP 2603414 B1 6/2013
JP 08-026240 1/1996

(Continued)

OTHER PUBLICATIONS

USPTO, International Search Report and Written Opinion issued in corresponding PCT Application No. PCT/US2011/047401, filed Aug. 11, 2011. dated Jan. 6, 2012.

(Continued)

*Primary Examiner* — Fenn C Mathew
(74) *Attorney, Agent, or Firm* — Fishman Stewart PLLC

(57) ABSTRACT

A stackable plastic container includes a base portion, a sidewall portion, and an upper portion. The base portion is configured to support the container, and includes an upwardly-extending central base portion and a base reinforcement formation. The sidewall portion extends upwardly from the base portion, and may include a sidewall reinforcement formation. The upper portion extends upwardly from the sidewall portion, and includes a shoulder portion, an angled portion, a neck portion, and a dispensing opening. The base portion may be configured to withstand hydrostatic pressure. A portion of the shoulder portion may be configured to flex downwardly in response to a top load force applied to the neck of the container. The upwardly extending central base portion may be configured to receive an upper portion of another container. With embodiments, in a stacked configuration, the upper portion of another container contacts the central base portion of the container.

30 Claims, 18 Drawing Sheets

Related U.S. Application Data of application No. 29/351,360, filed on Dec. 4, 2009, now Pat. No. Des. 662,421.

(58) Field of Classification Search
USPC ..... 206/511; 426/111; 220/23.6, 240, 519, 220/635, 666, 670
See application file for complete search history.

(56) References Cited

U.S. PATENT DOCUMENTS

| | | | | | |
|---|---|---|---|---|---|
| 3,397,724 | A | * | 8/1968 | Bolen et al. | 215/371 |
| D244,427 | S | | 5/1977 | Schieser et al. | |
| 4,301,933 | A | * | 11/1981 | Yoshino | 215/375 |
| 4,412,633 | A | | 11/1983 | Guerrazzi et al. | |
| 4,733,804 | A | | 3/1988 | Slat et al. | |
| D299,697 | S | | 2/1989 | Frahm et al. | |
| 4,805,793 | A | * | 2/1989 | Brandt et al. | 215/10 |
| 4,850,493 | A | | 7/1989 | Howard, Jr. | |
| D307,389 | S | | 4/1990 | Larson | |
| D311,329 | S | | 10/1990 | Frahm et al. | |
| 5,002,199 | A | * | 3/1991 | Frahm | 220/670 |
| D347,391 | S | | 5/1994 | Guertin | |
| D360,830 | S | | 8/1995 | Hestehave et al. | |
| D400,794 | S | | 11/1998 | Takeuchi et al. | |
| D403,243 | S | | 12/1998 | Takeuchi et al. | |
| 5,927,499 | A | * | 7/1999 | Vesborg | 206/509 |
| 6,068,161 | A | | 5/2000 | Soehnlen et al. | |
| 6,581,794 | B2 | * | 6/2003 | Boukobza | 215/383 |
| 6,588,612 | B1 | | 7/2003 | Dorn et al. | |
| 6,896,147 | B2 | * | 5/2005 | Trude | 215/373 |
| 6,932,225 | B2 | * | 8/2005 | Rowe | 211/90.02 |
| 6,932,228 | B1 | | 8/2005 | Darr et al. | |
| D526,199 | S | | 8/2006 | Darr et al. | |
| D527,648 | S | | 9/2006 | Darr et al. | |
| D530,212 | S | | 10/2006 | Darr et al. | |
| D532,694 | S | | 11/2006 | Darr et al. | |
| 7,467,714 | B2 | | 12/2008 | Slat et al. | |
| D587,126 | S | * | 2/2009 | DeSico et al. | D9/541 |
| D607,337 | S | | 1/2010 | Zoppas | |
| D607,338 | S | | 1/2010 | Zoppas | |
| D618,553 | S | | 6/2010 | Zoppas | |
| 8,210,391 | B2 | * | 7/2012 | Luburic | 220/635 |
| 2003/0010743 | A1 | * | 1/2003 | Boukobza | 215/382 |
| 2005/0260371 | A1 | * | 11/2005 | Shi | B29B 11/08 428/35.7 |
| 2006/0000740 | A1 | * | 1/2006 | Sigur | 206/509 |
| 2008/0000867 | A1 | | 1/2008 | Lane et al. | |
| 2008/0035637 | A1 | | 2/2008 | Shehadey et al. | |
| 2010/0326872 | A1 | * | 12/2010 | Rivera | B65D 21/0231 206/509 |
| 2011/0132790 | A1 | | 6/2011 | Dorn | |

FOREIGN PATENT DOCUMENTS

| | | |
|---|---|---|
| JP | 3046074 | 11/1997 |
| JP | 2000-127231 | 5/2000 |
| JP | 3072867 | 8/2000 |
| JP | 2006-248595 | 9/2006 |
| JP | 2008-030856 | 2/2008 |
| WO | WO-2012021691 A1 | 2/2012 |

OTHER PUBLICATIONS

Canadian Office Action, Serial No. 2,807,500, dated Jun. 5, 2017.

* cited by examiner

STACKABLE PLASTIC CONTAINER

CROSS-REFERENCE TO RELATED APPLICATIONS

This application is a continuation-in-part of application Ser. No. 12/855,902, filed Aug. 13, 2010, now U.S. Pat. No. 9,352,873issued May 31, 2016, which is a continuation-in-part of application Ser. No. 29/351,360, filed Dec. 4, 2009, now U.S. Patent No. D.662,421, issued Jun. 26, 2012, which are both hereby incorporated by reference as though fully set forth herein. This application additionally is a continuation-in-part of application Ser. No. 29/360,887, filed May 3, 2010, now U.S. Patent No. D.635,460, issued Apr. 5, 2011, which is also hereby incorporated by reference as though fully set forth herein.

TECHNICAL FIELD

The present disclosure relates generally to stackable plastic containers, including those capable of case-less shipping.

BACKGROUND

Plastic containers are used for storing a wide variety of contents. It is often desirable to provide containers that are stackable and promote shipping efficiency. Conventional stackable containers commonly are provided with sidewall portions that are structurally reinforced with the objective of prohibiting deformation associated with top loading and hydrostatic forces.

SUMMARY

Embodiments of a stackable plastic container for holding contents are disclosed. In embodiments, the container includes a base portion, a sidewall portion, and an upper portion. The base portion is configured to support the container on a surface. The base portion includes an upwardly-extending central base portion and one or more base reinforcement formations. The sidewall portion extends upwardly from the base portion, and may include one or more sidewall reinforcement formations. The upper portion extends upwardly from the sidewall portion, and includes a shoulder portion, an angled portion, a neck portion, and a dispensing opening. The base portion may be configured to withstand hydrostatic pressure. A portion of the shoulder portion may be configured to flex downwardly in response to a top load force applied to the container. Further, the upwardly extending central base portion may be configured to receive an upper portion of another container. With embodiments, in a stacked configuration, the neck portion of another container contacts the central base portion of the container.

BRIEF DESCRIPTION OF THE DRAWINGS

Embodiments of the invention will now be described, by way of example, with reference to the accompanying drawings, wherein.

DETAILED DESCRIPTION

Reference will now be made in detail to embodiments of the present invention, examples of which are described herein and illustrated in the accompanying drawings. While the invention will be described in conjunction with embodiments, it will be understood that they are not intended to limit the invention to these embodiments. On the contrary, the invention is intended to cover alternatives, modifications and equivalents, which may be included within the spirit and scope of the invention as defined by the appended claims.

Figure 1A:
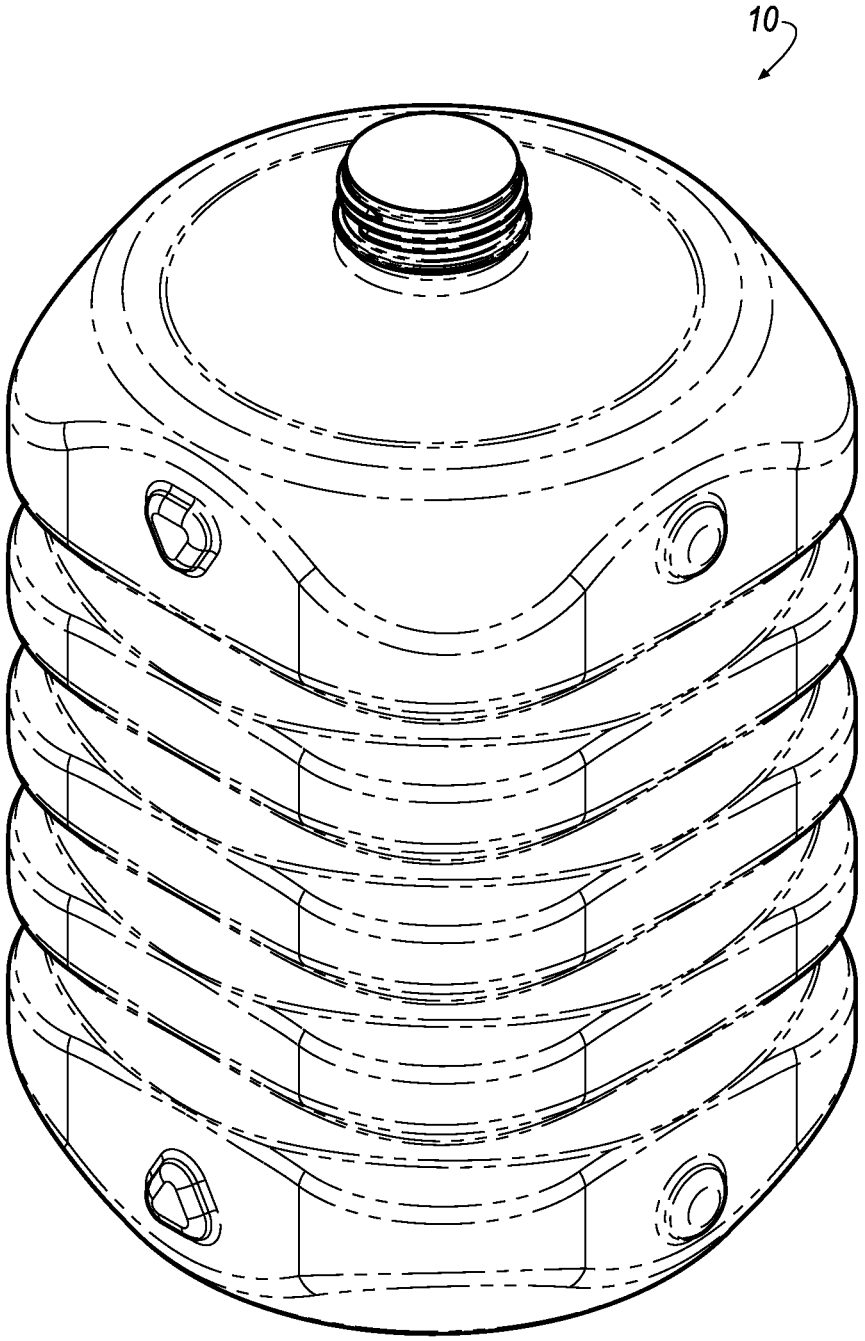
FIGS. 1A, 1B, and 1C are isometric views of embodiments of a container embodying aspects of the present invention.
Figure 1B:
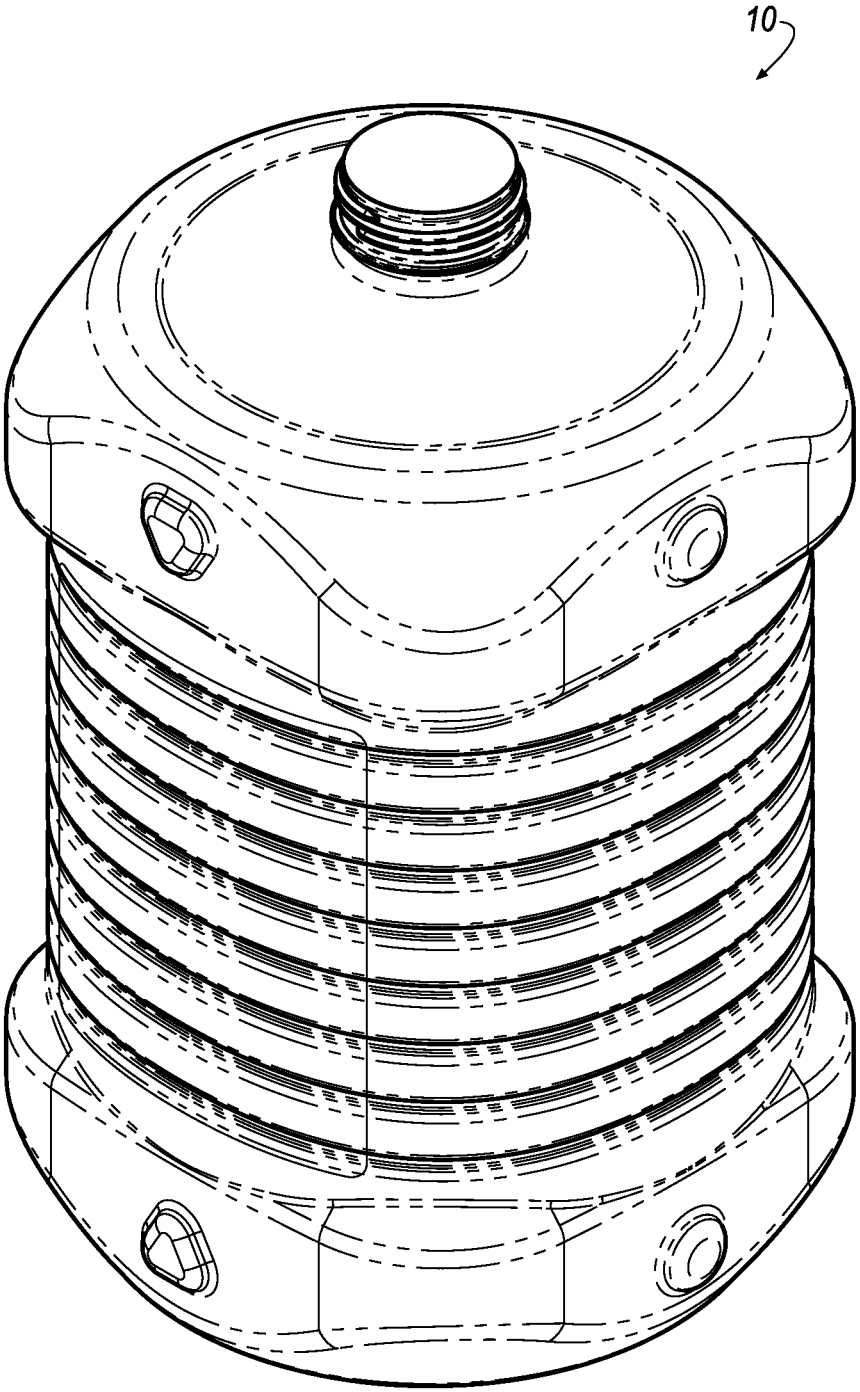
Figure 1C:
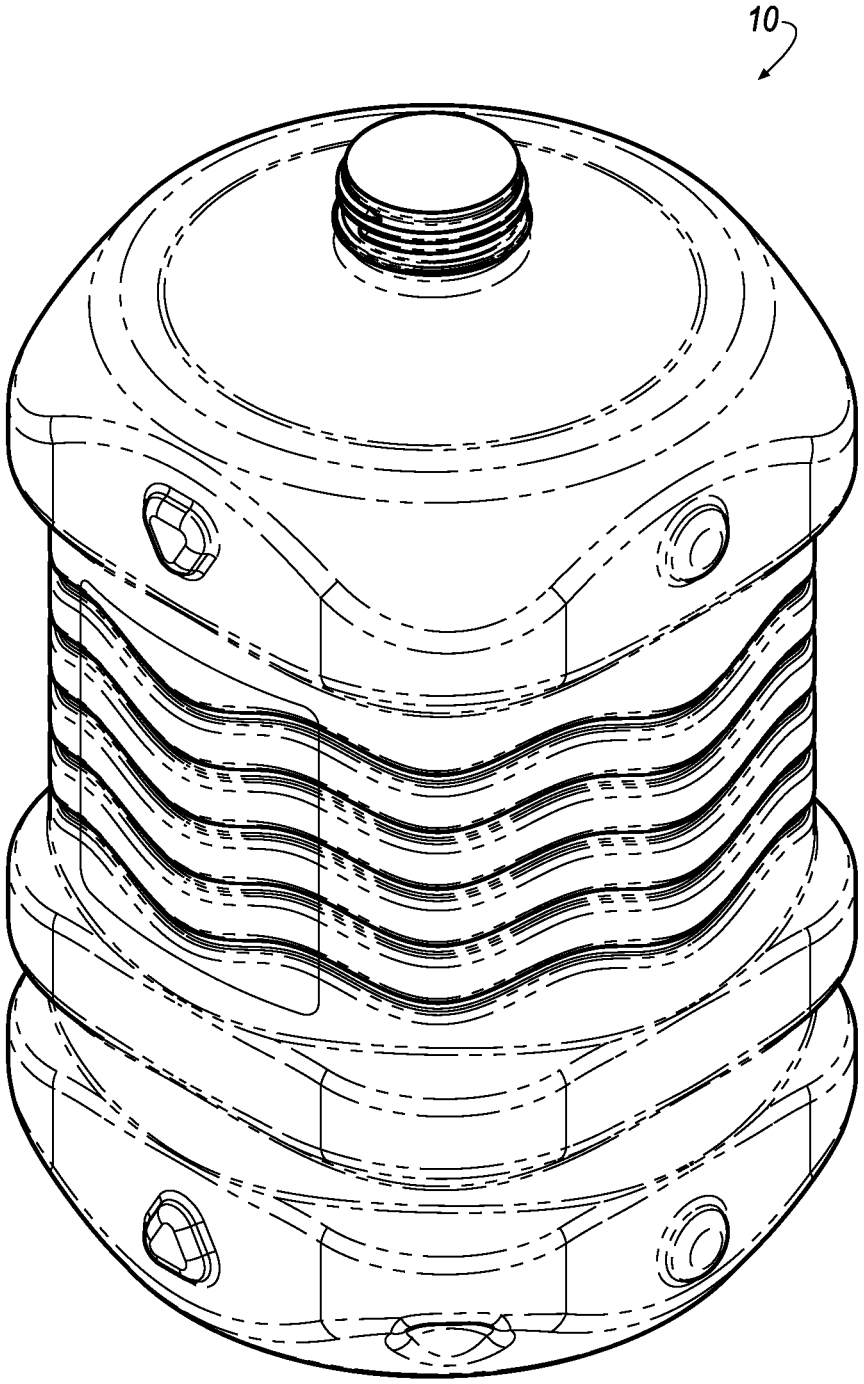

Isometric views of embodiments of a container 10 exhibiting aspects of the teachings of the present invention are generally shown in FIGS. 1A, 1B, and 1C. As generally illustrated in FIGS. 2A, 2B, and 2C, the illustrated containers 10 may include a closed base portion 20; a sidewall portion 30, and an upper portion 40.

Figure 4:
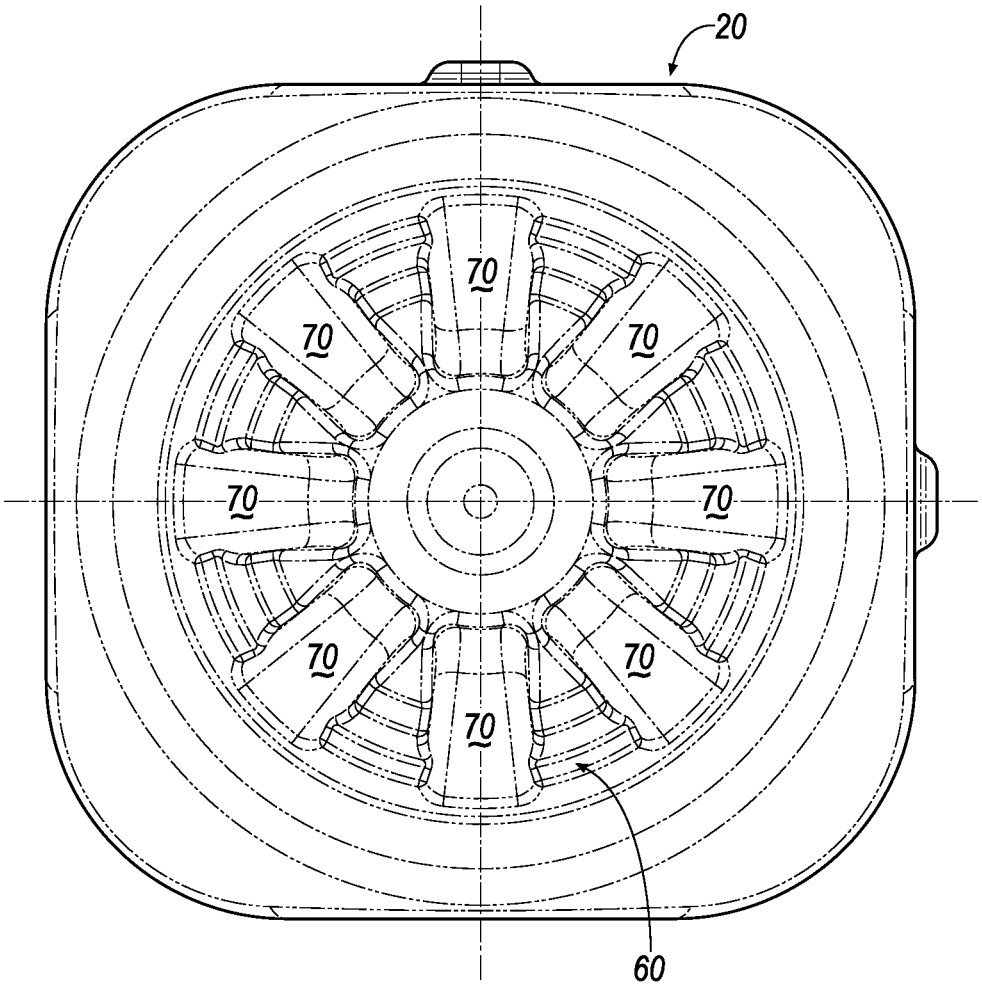
FIG. 4 is a bottom view of the containers shown in FIGS. 1A, 1B, and 1C, respectively.

The base portion 20 can be configured to support the container on a surface, such as a substantially planar support surface. The base portion 20 includes an upwardly-extending central base portion 50, and may include one or more base reinforcement formations. Without limitation, an example of a base portion is shown in FIG. 4. Such base reinforcement formations may include, without limitation, one or more stepped portions 60 (which may be ring-shaped) and/or one or more ribs 70 (or other radially-extending formations). In embodiments, the central base portion 50 is configured to receive at least a portion of an upper portion 40 of another container (which may or may not include a cap or closure)—for example, a neck portion of a container positioned below it (see, e.g., FIGS. 7 and 8). Additionally, with embodiments, the base portion 20 may be configured to withstand hydrostatic pressure, including increased hydrostatic pressures that may be interrelated with top loading and resultant load forces.

As generally illustrated, the sidewall portion 30 extends upwardly from the base portion 20. In embodiments, by way of example and without limitation, the wall thickness of the sidewall portion of the container may be about 0.020±0.006 in. For some embodiments, the sidewall portion of the container may have a generally square or rounded-square cross-section, which may, if desired, extend substantially along an entire vertical length of the sidewall portion. Further, the sidewall portion may include one or more sidewall reinforcement formations 80. Such sidewall reinforcement formations may comprise, for example and without limitation, a plurality of substantially horizontal reinforcement ribs/formations. Such sidewall reinforcement formations 80 may be continuous—e.g., extending around the circumference of the container, or for other embodiments may be non-continuous and may have one or more interruptions. It is important to note that the present disclosure is not limited to the sidewall reinforcement formations that are illustrated, and various other forms of known sidewall reinforcement formations/features may be added and/or substituted.

Figure 2A:
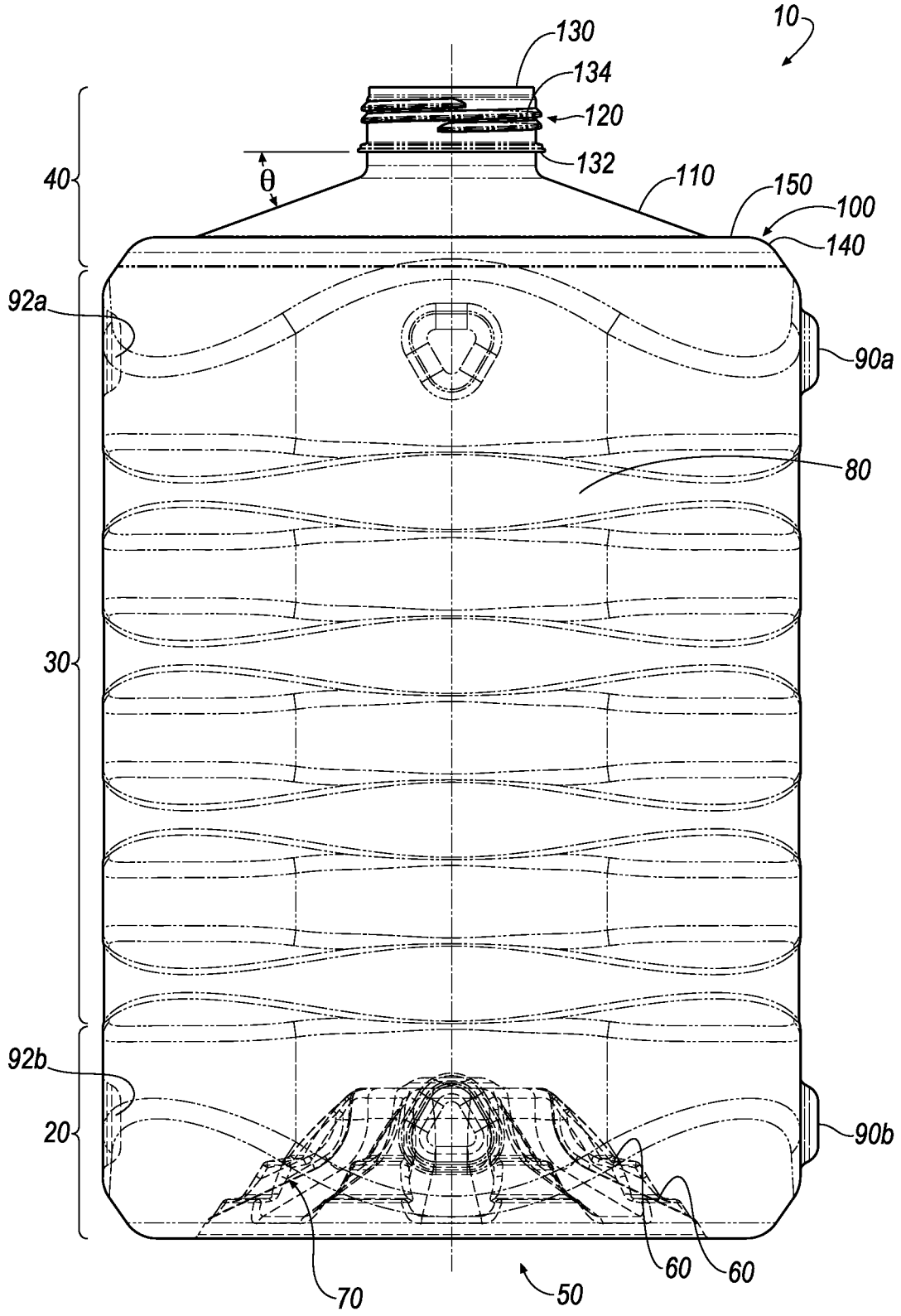
FIGS. 2A, 2B, and 2C are front elevation views of the container shown in FIGS. 1A, 1B, and 1C, respectively.
Figure 2B:
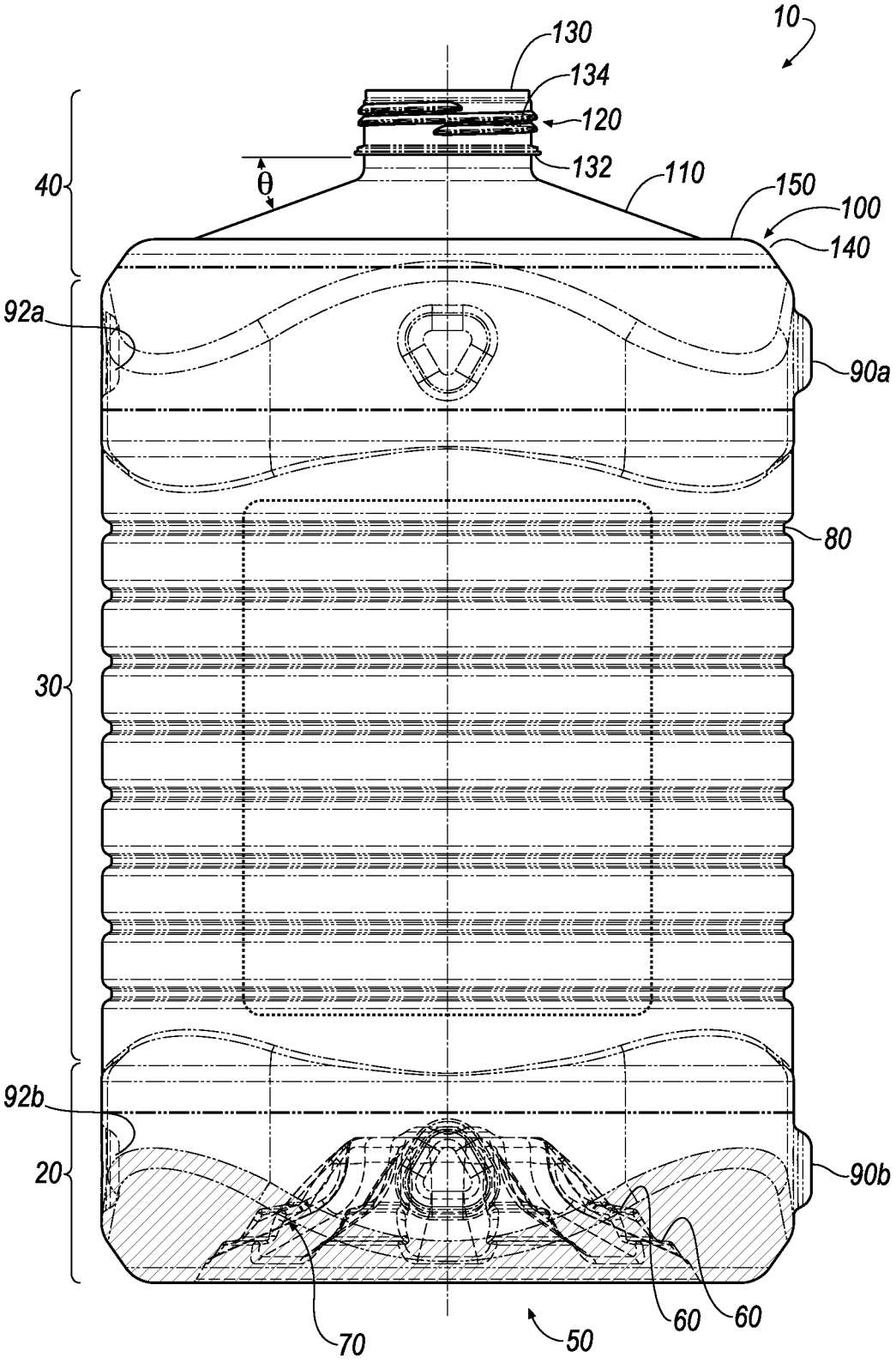
Figure 2C:
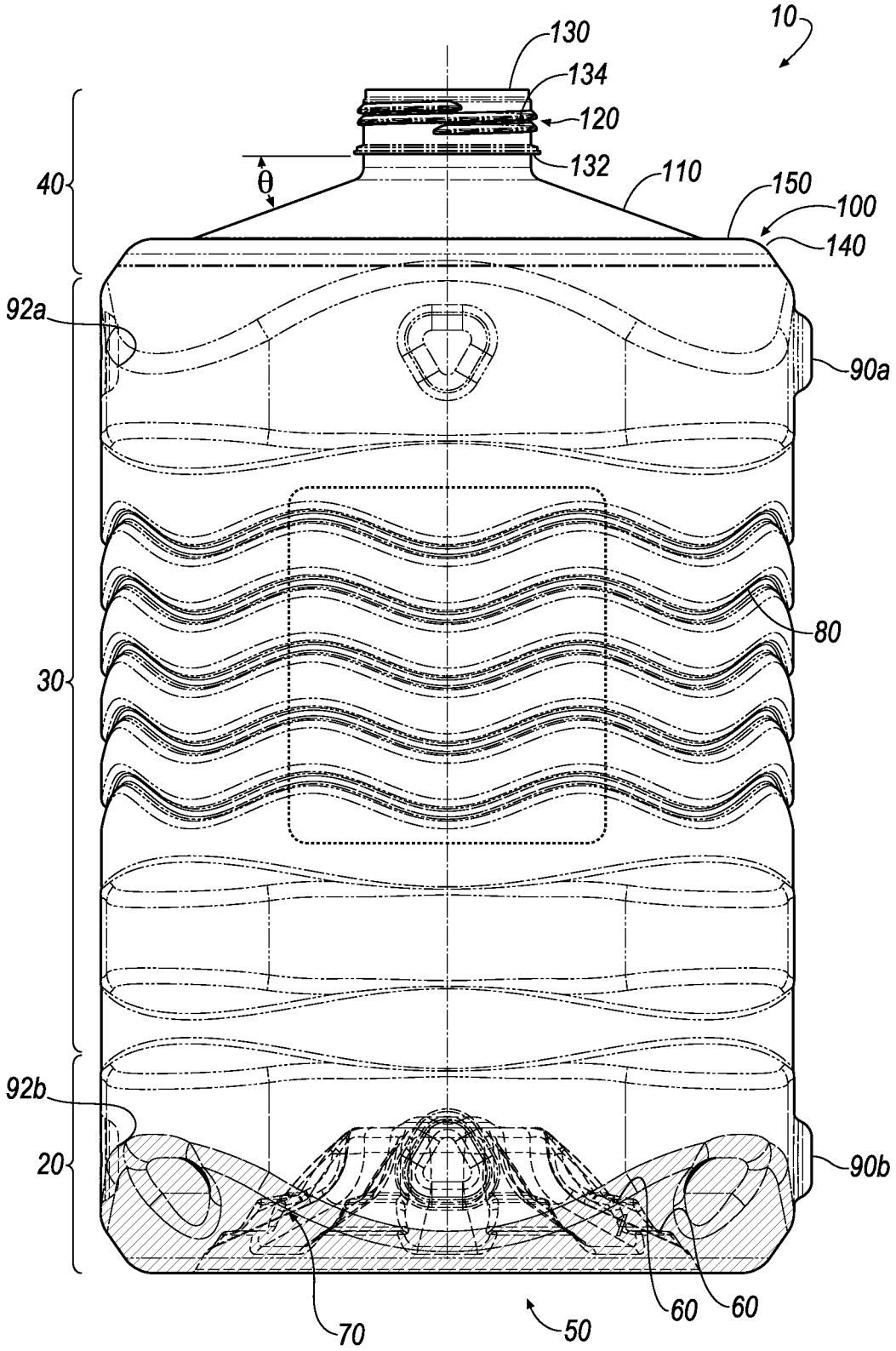
Figure 3A:
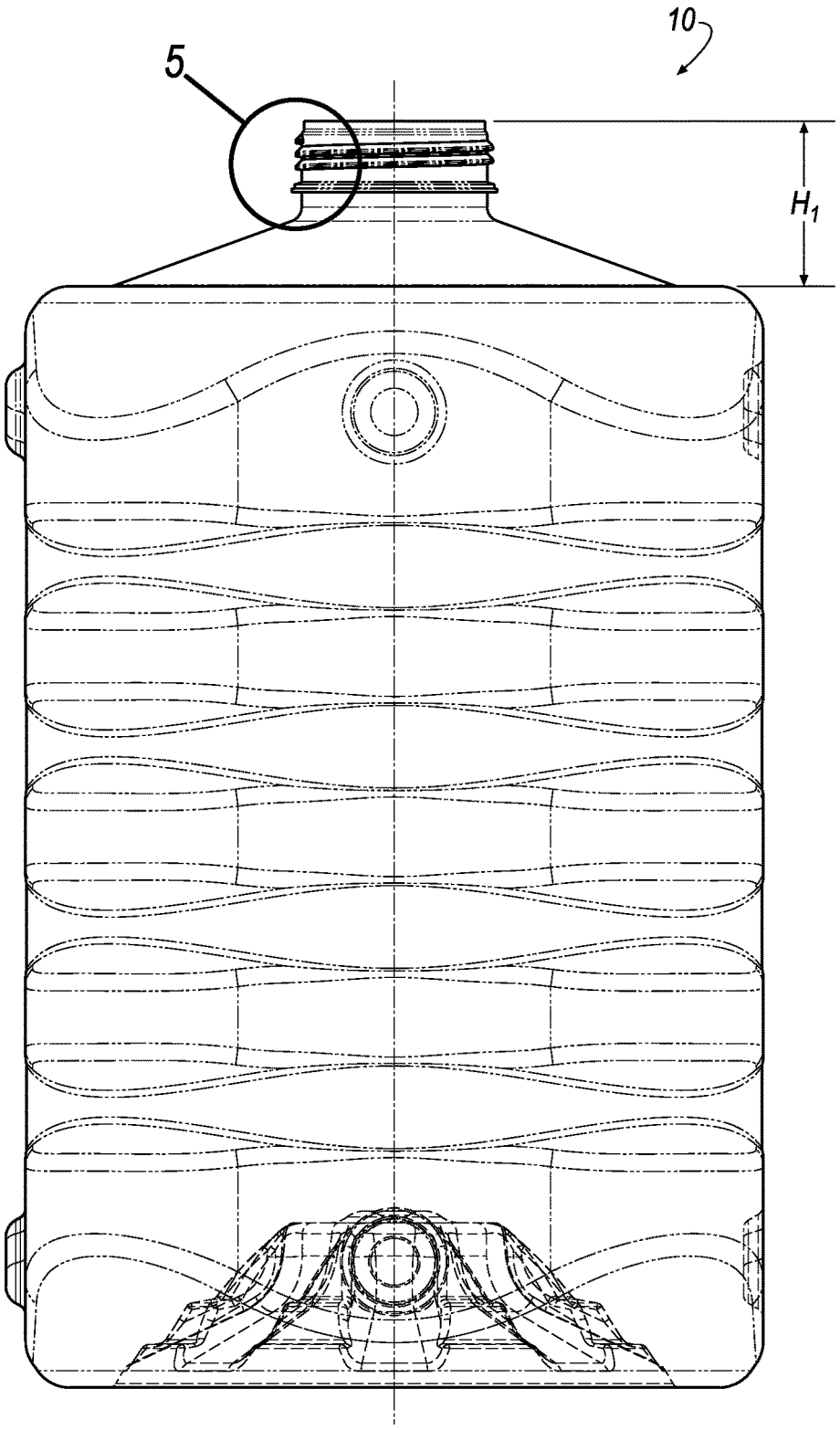
FIGS. 3A, 3B, and 3C are right side elevation views of the container shown in FIGS. 1A, 1B, and 1C, respectively.
Figure 3B:
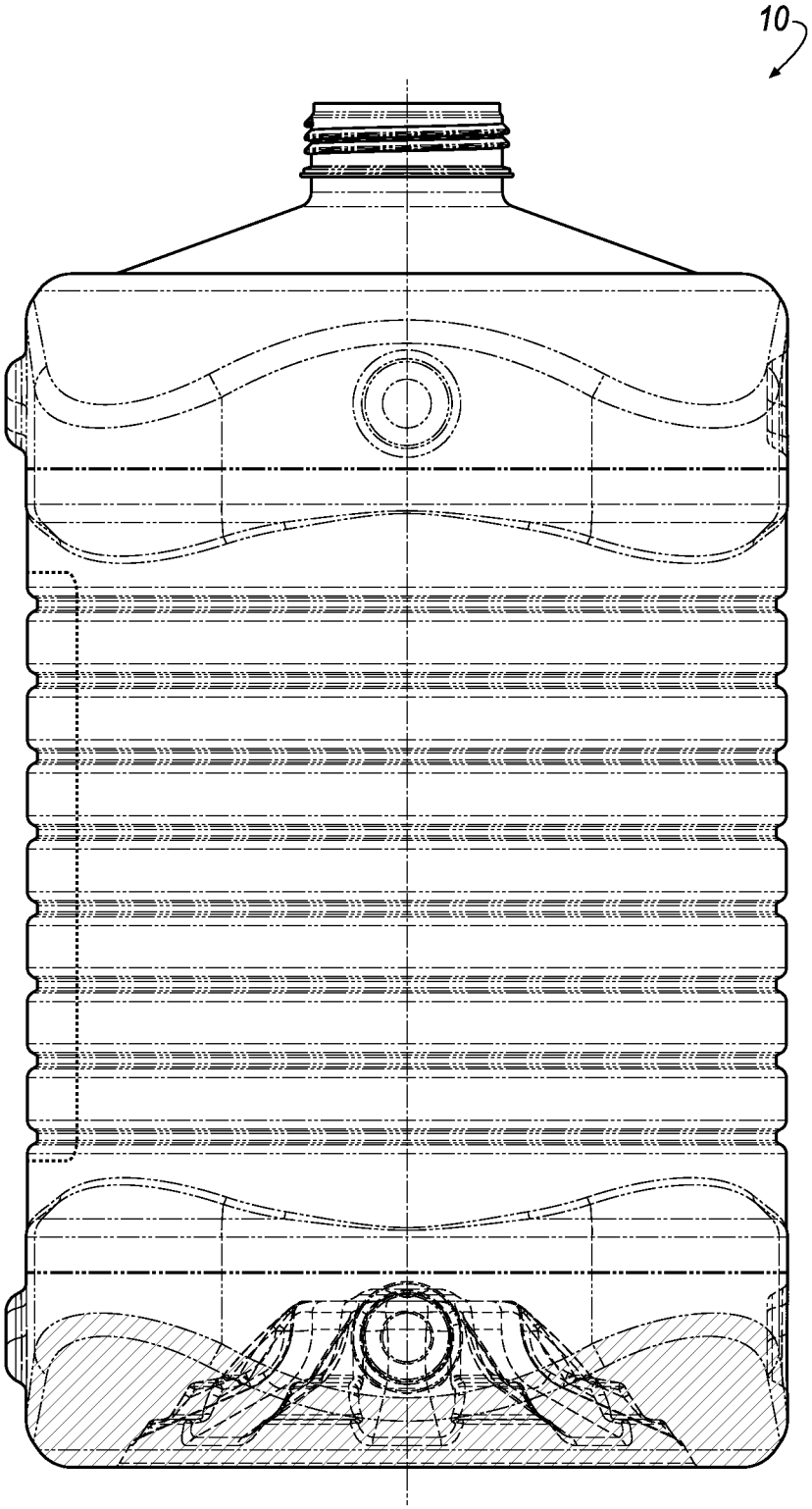
Figure 3C:
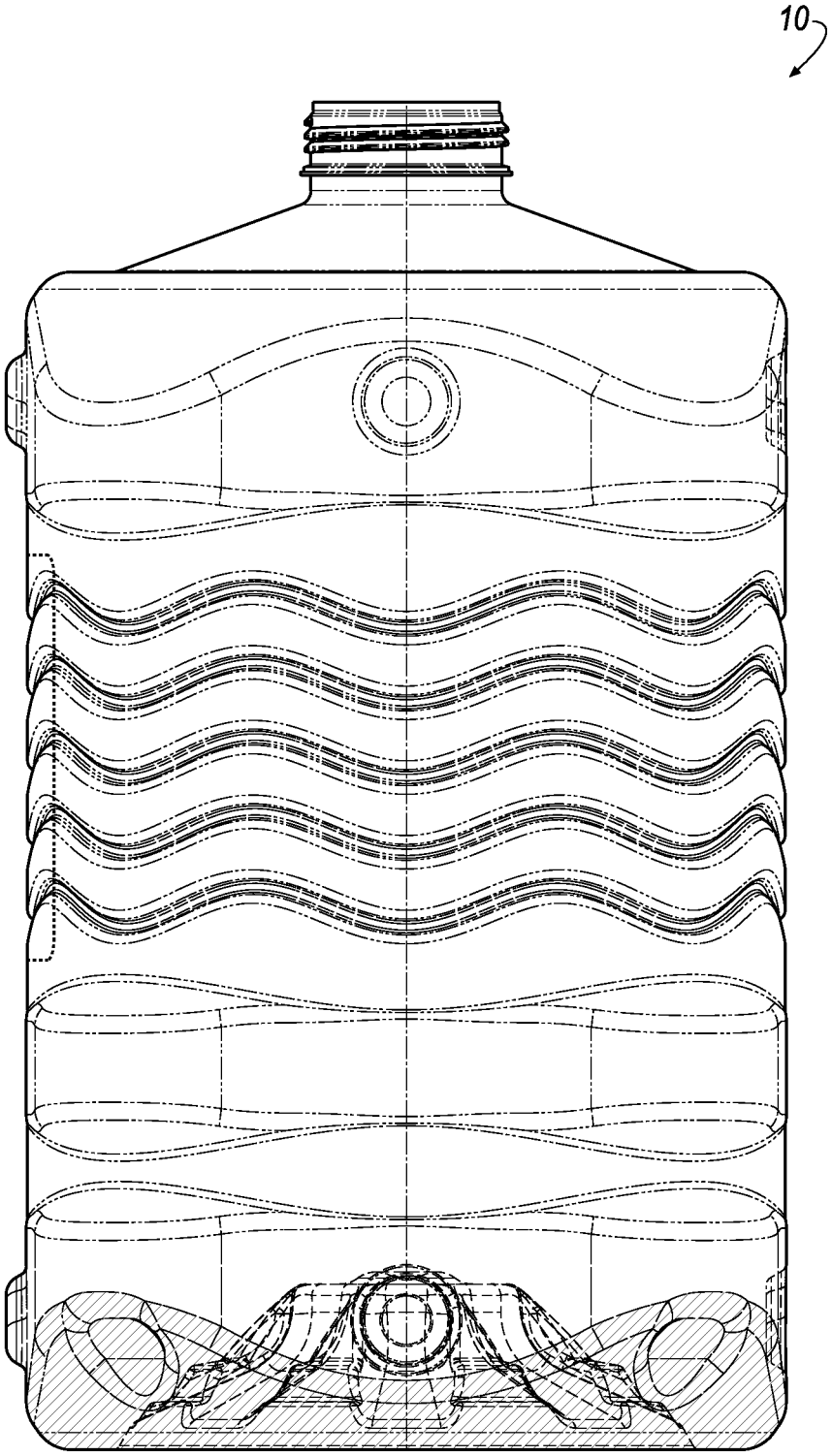

By way of example, and as generally illustrated in FIGS. 2A, 2B, and 2C, sidewall reinforcement formations, if included, may be provided in a wide variety of numbers, forms, spacing, and sizes. For example, and without limitation, in FIGS. 1A, 2A, 3A and FIGS. 1C, 2C, and 3C, the sidewall reinforcement formations 80 are shown generally in the form of horizontally-extending, wave-like ribs. The vertical height of the sidewall reinforcement formations 80 in FIGS. 1A, 2A, and 3A is shown varying around the circumference of the container. In contrast, in FIGS. 1C, 2C, and 3C, the vertical height of the sidewall reinforcement formations 80, while wave-like, is substantially consistent around the circumference of the container. Alternatively, as generally illustrated in FIGS. 1B, 2B, and 3B, the sidewall reinforcement formations 80 may take the form of substantially straight-horizontal ribs that may have substantially similar vertical heights and radial depths.

As generally shown, for example, in FIG. 2A, the sidewall may additionally include formations—e.g., protruding formations 90*a*, 90*b* and receiving formations 92*a*, 92*b*—that may be used to interconnect adjacent containers. For example, receiving formations 92*a* and 92*b* may be configured to receive a substantial portion of protruding formations 90*a* and 90*b* of a similar container when such containers are positioned adjacent one another.

Figure 5:
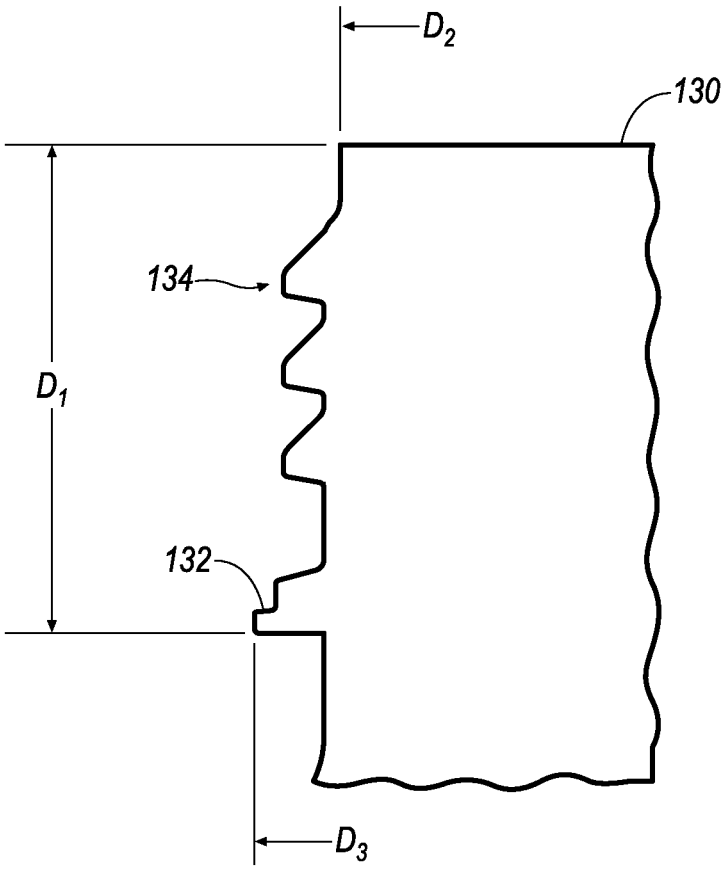
FIG. 5 is a finish detail view for a container such as shown in FIGS. 1A, 1B, and 1C.

An upper portion 40 extends upwardly from the sidewall portion 30. In embodiments, the upper portion 40 includes a shoulder portion 100, an angled portion 110, and a neck portion 120 with a dispensing opening 130. The angled portion 110 may, for example, form an angle Θ (relative to the horizontal) that is about 20±5 degrees. It is commonly desirable to provide an angle Θ such that with the container the angled portion 110 will not deform significantly under anticipated loads (i.e., other portions of the upper portion 40 will flex or deform first). Further, in embodiments, the neck portion 120 may additionally include a support ring 132 and/or a closure-receiving formation (e.g., threads 134). FIG. 5 depicts an enlarged finish detail view for embodiments of containers, such as shown in FIGS. 1A, 1B, and 1C. In the illustrated detail view, for example and without limitation, the vertical distance $D_1$ from the bottom of support ring 132 to the top of the container (at the top of the dispensing opening 130) may be about 0.90±0.20 inches. Moreover, if desired, the outer diameter $D_2$ at the uppermost portion of the container may be about 2.295±0.010 inches, and the outer diameter $D_3$ at the outer portion of the support ring may be about 2.611±0.010 inches. However, that the disclosure is not limited to the illustrated finish, and various other neck finish configurations, including many conventional configurations, may be utilized.

Figure 6:
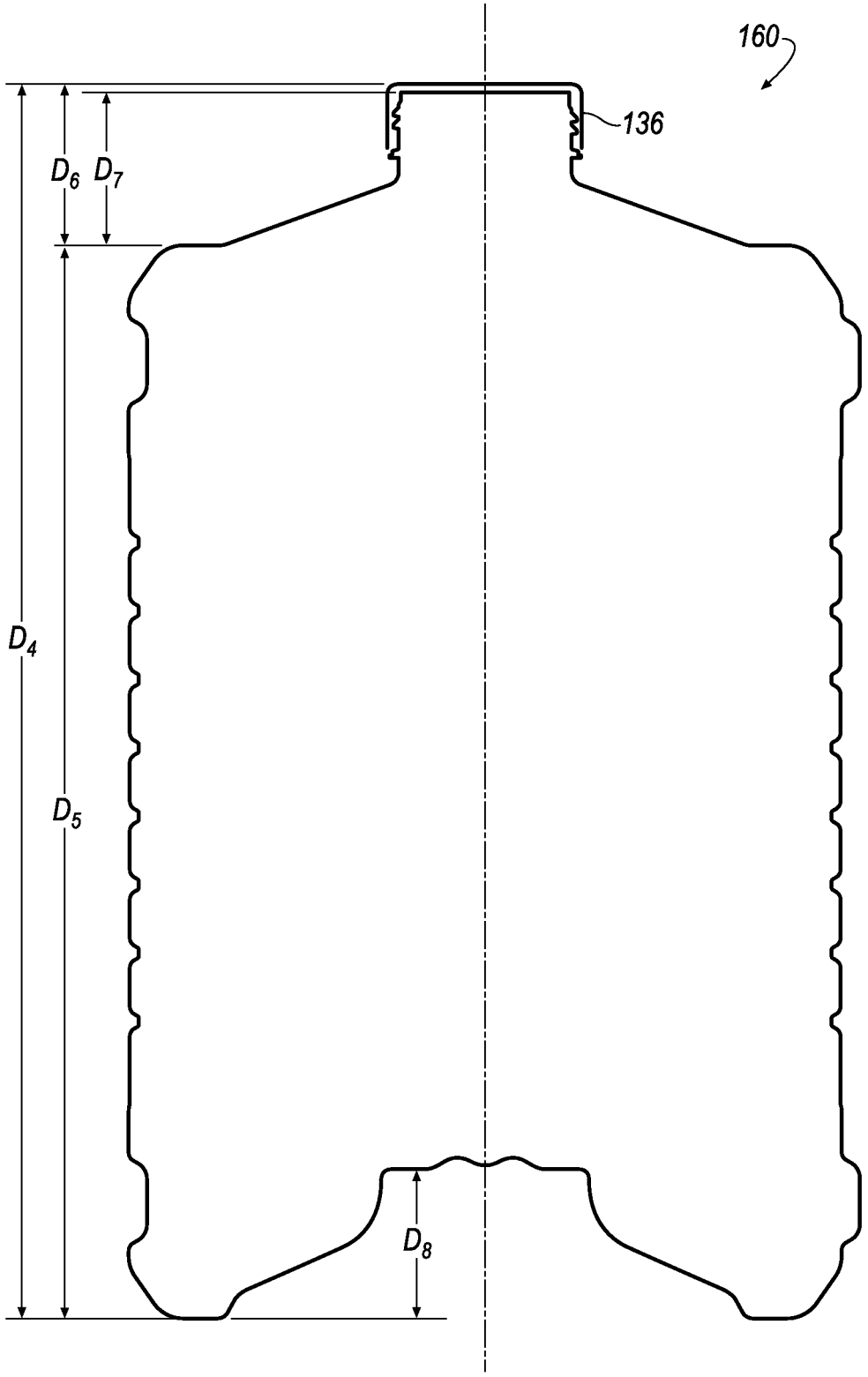
FIG. 6 is a cross-sectional representation of an embodiment of a container.
Figure 8:
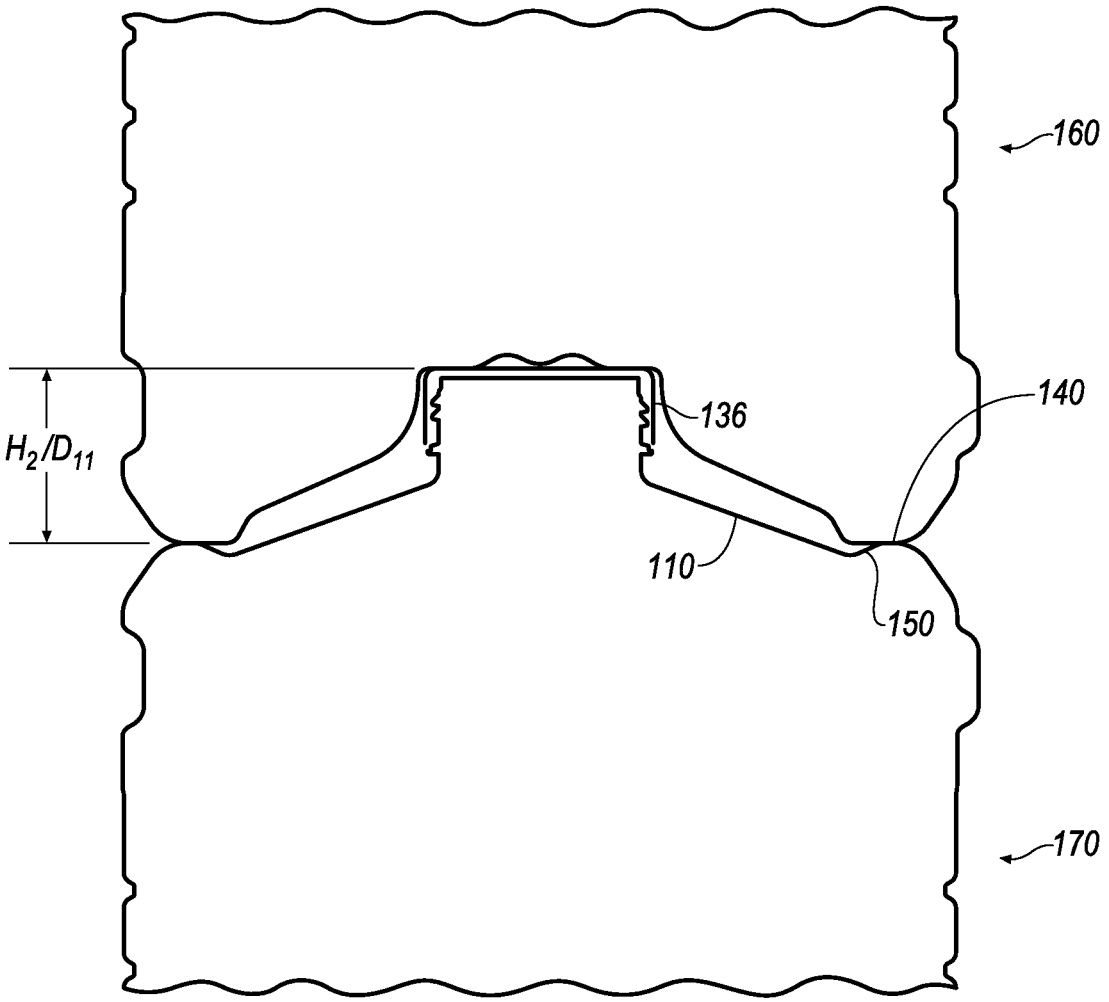
FIG. 8 is an enlarged view of a portion of FIG. 7.

The neck portion 40 may also include a closure or cap, such as closure 136 generally represented in FIGS. 6 and 8, which may be configured to seal the container. Moreover, for some embodiments, after filing with contents (such as, without limitation, a liquid), a seal (such as a conventional foil seal) may be provided over the dispensing opening 130 of the container. It is commonly desirable to provide an air-tight sealing of the contents and, if desired, various sealing techniques (including induction-sealing) may be employed.

The shoulder portion 100 may comprise a rounded portion 140 and a flex portion 150. The flex portion 150 may be provided between the rounded portion 140 and the angled portion 110. The flex portion 150 can be configured to flex (or deform) generally downwardly (see e.g., FIG. 8) in response to a top load force applied to the container 10. For example, the flex portion 150 may be configured to accommodate a top load force associated with the weight of one or more containers stacked thereupon. For embodiments, such as those illustrated in FIGS. 2A, 2B, and 2C, the flex portion 150 may comprise a substantially flat, generally horizontal-extending segment. However, the flex portion is not limited to the form illustrated in the exemplary figures, and other variations that provide a similar functionality may be utilized.

Moreover, in embodiments, in an unloaded condition (e.g., when no top load is applied), the vertical height $H_1$ of the upper portion 40 (see, e.g., FIG. 3A) is greater than the vertical height $H_2$ of the central base portion 50 that is configured to receive such upper portion 40 (see, e.g., FIG. 8). Although a closure 136 is included with the representation of the upper portion illustrated in FIG. 8, the vertical height $H_1$ of the upper portion may be the vertical height with or without the inclusion of a closure.

A cross-sectional representation of an embodiment of a first container 160 is generally illustrated in FIG. 6. The container 160 is shown including a closure 132. For purposes of illustrating concepts associated with the present disclosure, first container 160 may, for example, have the following vertical dimensions:

| | | |
|---|---|---|
| $D_4$ | total vertical height of container | 16.900 inches |
| $D_5$ | vertical height from bottom base portion to top of shoulder portion | 14.704 inches |
| $D_6$ | vertical height from top of shoulder to top of container (including closure) | 2.196 inches |
| $D_7$ | vertical height from top of shoulder to top of dispensing opening (without closure) | 2.096 inches |
| $D_8$ | vertical height from support surface to central portion of central base portion configured to engage upper portion of second container (below) | 2.046 inches |

Figure 7:
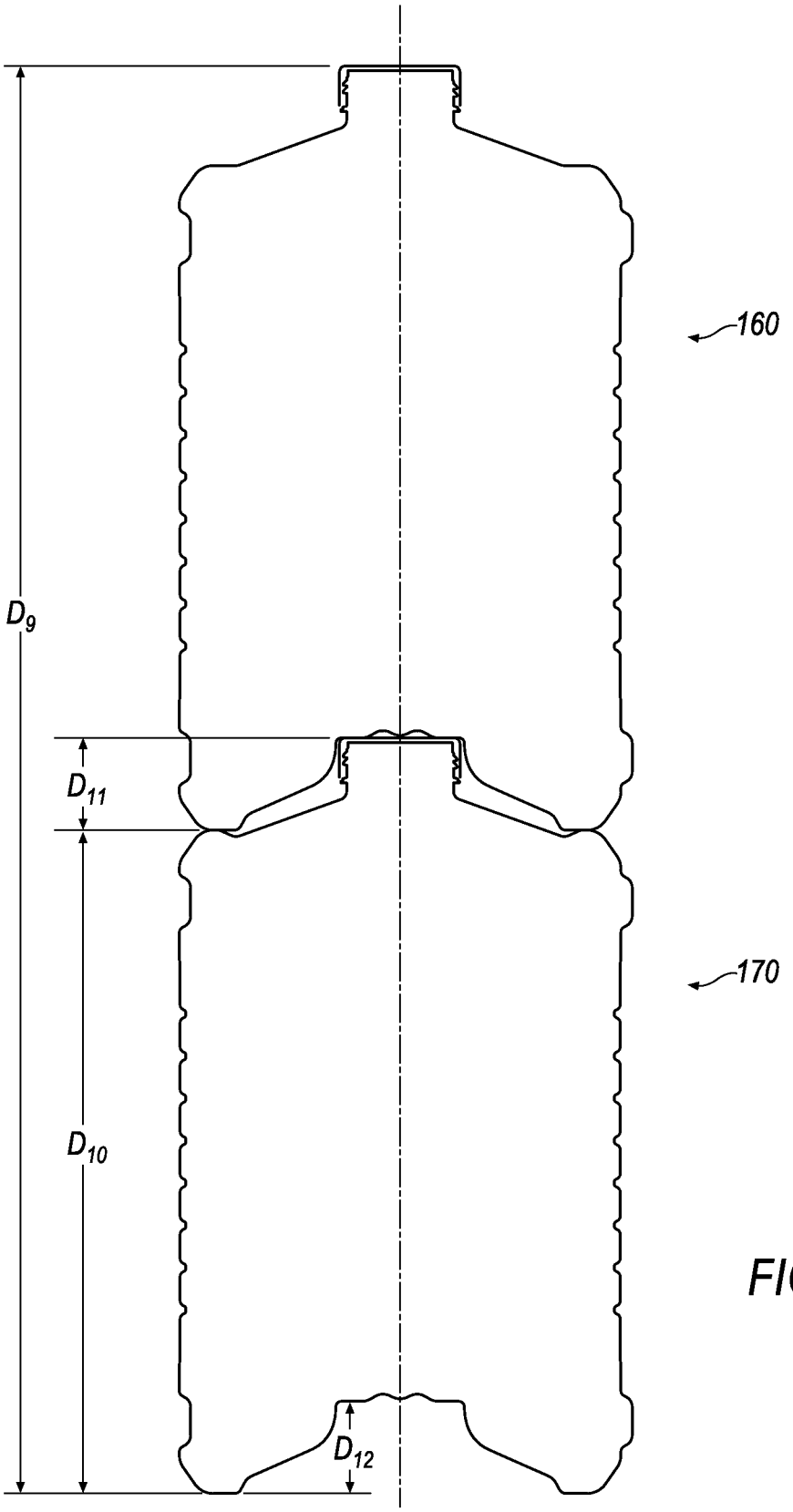
FIG. 7 is a cross-section representation of embodiments of two containers, shown in a stacked configuration.

A cross-sectional representation of embodiments of two containers—a first container 160 and a second container 170—shown in a stacked configuration, is generally illustrated in FIG. 7. Similarly, and for purposes of illustrating concepts associated with the present disclosure, the stacked combination of the first container 160 and second container 170 may, for example, have the following vertical dimensions:

| | | |
|---|---|---|
| $D_9$ | total vertical height of the stacked first and second containers | 31.604 inches |
| $D_{10}$ | vertical height from bottom base portion to top of shoulder portion of second (bottom) container | 14.704 inches |
| $D_{11}$ | vertical height from top of shoulder of the second container to top of second container (including closure) | 2.046 inches |
| $D_{12}$ | vertical height from support surface to central portion of central base portion of second container configured | 2.046 inches |

-continued

| |
|---|
| to engage upper portion of another container |

It is important to note that the foregoing specific dimensions are included merely to illustrate certain concepts associated with the present disclosure, and the inventive concept is not limited to such dimensions.

An enlarged view of a portion of FIG. 7 showing the engagement of stacked first and second containers 160, 170 is shown in FIG. 8. In a stacked configuration, the neck portion of a bottom container may generally be said to contact a portion of the central base portion of a top container. For example, as generally illustrated, the uppermost surface of the second (bottom) container 170—i.e., the uppermost surface of the closure 136 of the second container—is in contact with the upwardly-extending central base portion 50 of first (upper) container—more specifically, the portion of the first container 160 configured to receive such uppermost surface of the second container 170. As generally illustrated in FIG. 8, the upper portion 40 of the second container 170 is pressed downward in response to a top load force. As generally illustrated, a portion of shoulder portion 140 of second container 170 may contact a portion of the base portion 20 of the first container 160. Moreover, a portion of the upper portion 40—e.g., the flex portion 150—of the second container 170 may flex or deform downwardly to help accommodate the different dimensions (or "interference") between dimension $D_6$ (e.g., 2.196 in.) of the second container 170 and dimension $D_{11}$ (e.g., 2.046 in.) of the first container 160. For instance, in the illustrated example, the interference dimension would be 0.150 inches.

Under such circumstances, with the upper portion 40 of the lower-stacked container being moved downwardly, and assuming the other dimensions of the lower container remain substantially the same, the volume within the lower container will decrease and, if the container is sealed, and the hydrostatic pressure within the lower container associated with the contents will help support (and distribute) the weight of the upper-stacked container. In an embodiment, sidewall portion 30 can be configured to accommodate internal content pressure associated with a top load force of at least 75 pounds. Further, for other embodiments, the contents may have a density that is between about 0.90 and about 0.95 g/cm$^3$. Even with some amount of unfilled "head space" provided within the second container 170, as the upper portion compresses downwardly in response to a top load, the container will gain support strength as the hydrostatic force associated with the contents helps to counter or equalize the top load force. That is, embodiments of the present disclosure can, among other things, employ a measure or degree of controlled flexing/compression in an intended portion/zone (e.g., the upper portion—including the shoulder portion), so that the hydrostatic force associated with the contents of the container can be utilized to help counter at least a portion of the top load force that is incurred.

Moreover, it is noted, that the amount of compression associated with the aforementioned interference and accommodation can be adjusted. That is, the configuration of the upper portion of a container can be modified to adjust the anticipated resultant interferences for different containers and/or contents (both types and volumes).

Figure 9:
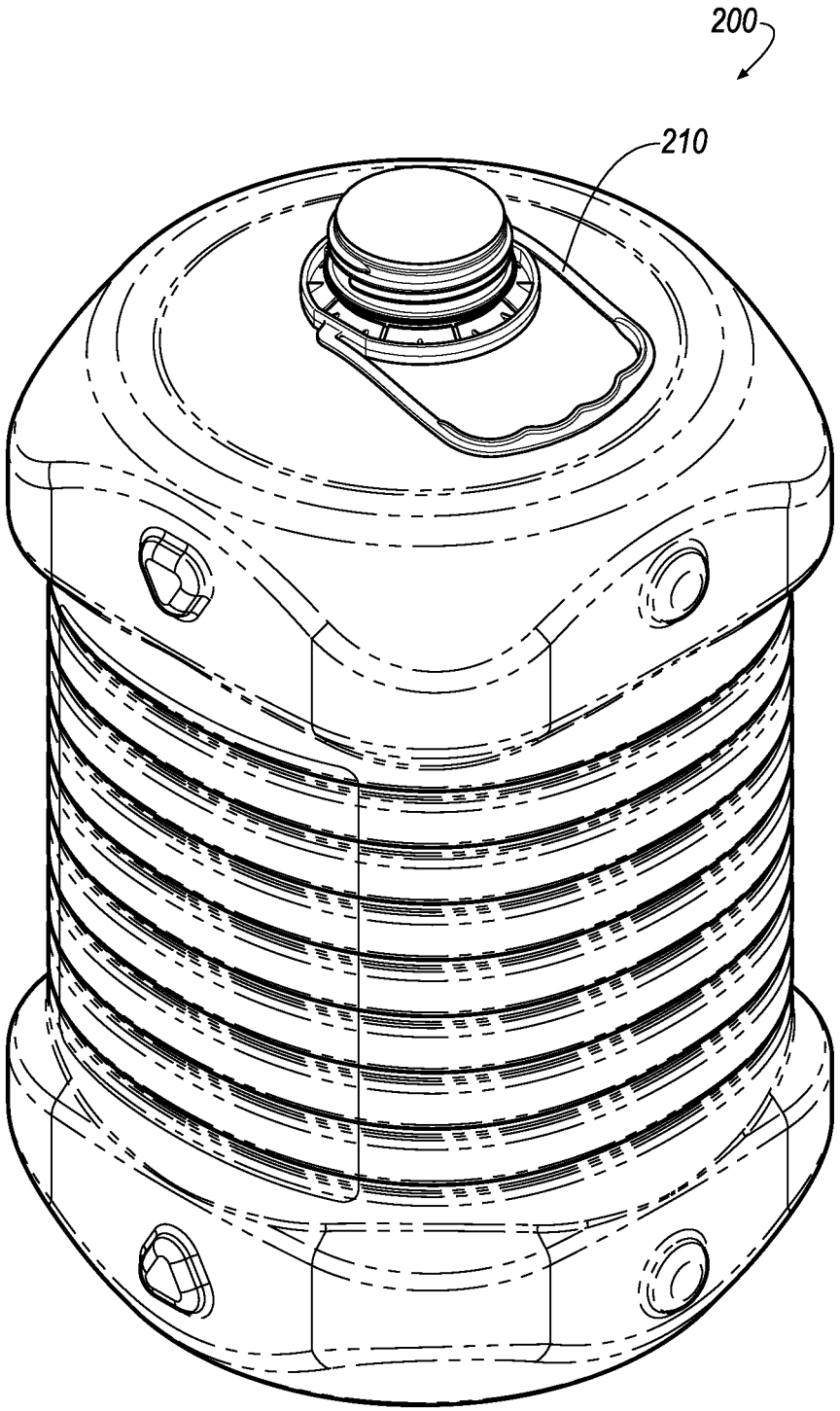
FIG. 9 is an isometric view of an embodiment of a container including a handle.
Figure 10:
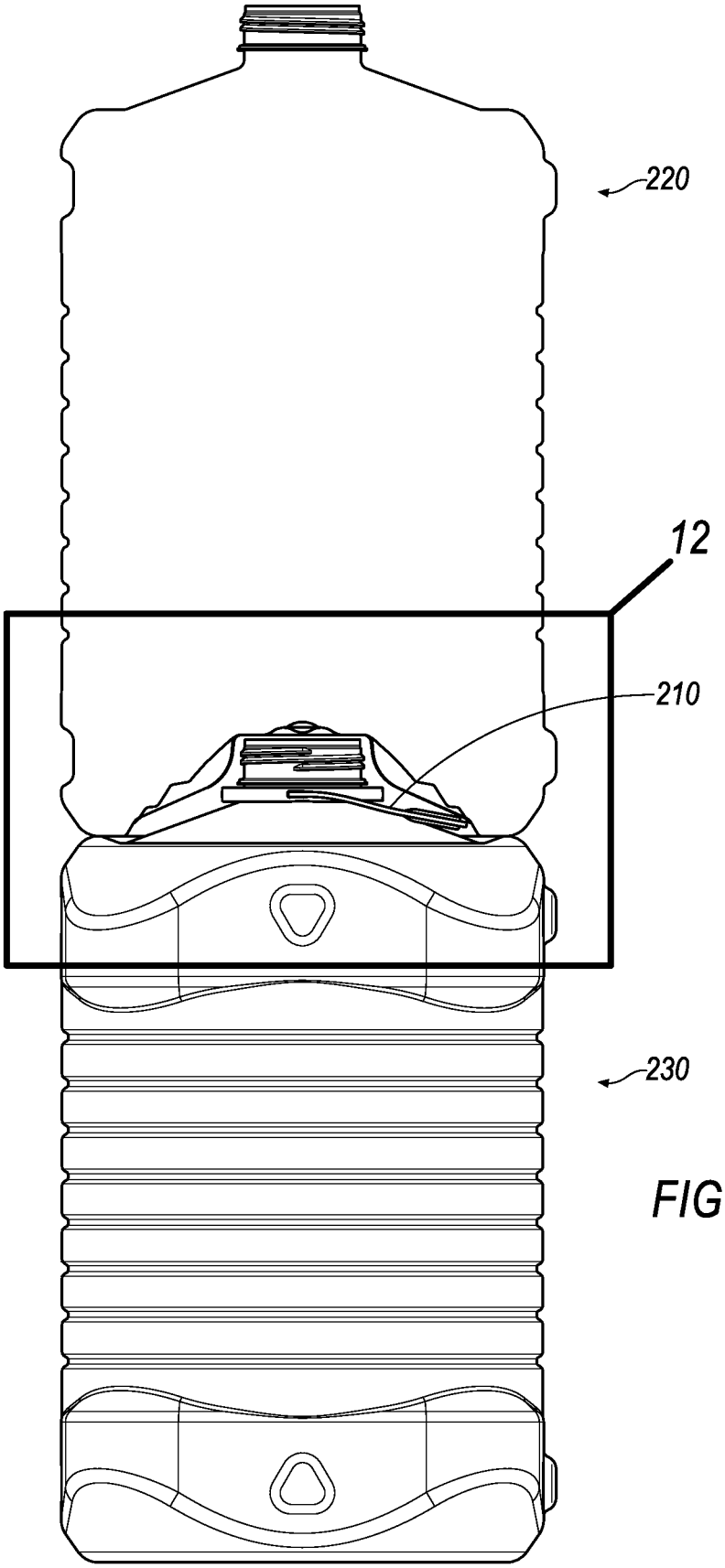
FIG. 10 is a side view of an embodiment of two stacked containers, the lower container including a handle.
Figure 11:
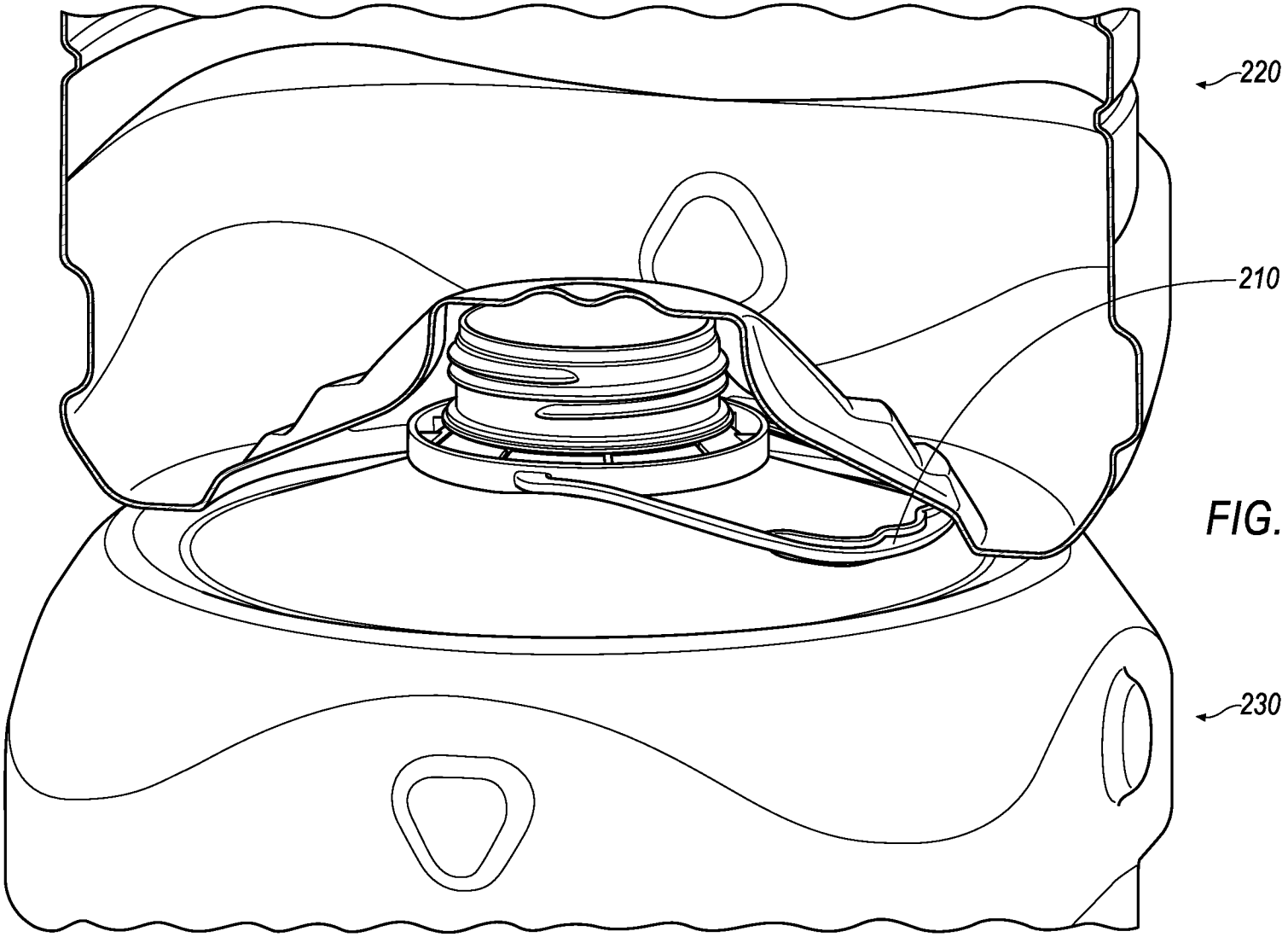
FIG. 11 is an isometric view of an enlarged portion of the containers shown in FIG. 10.
Figure 12:
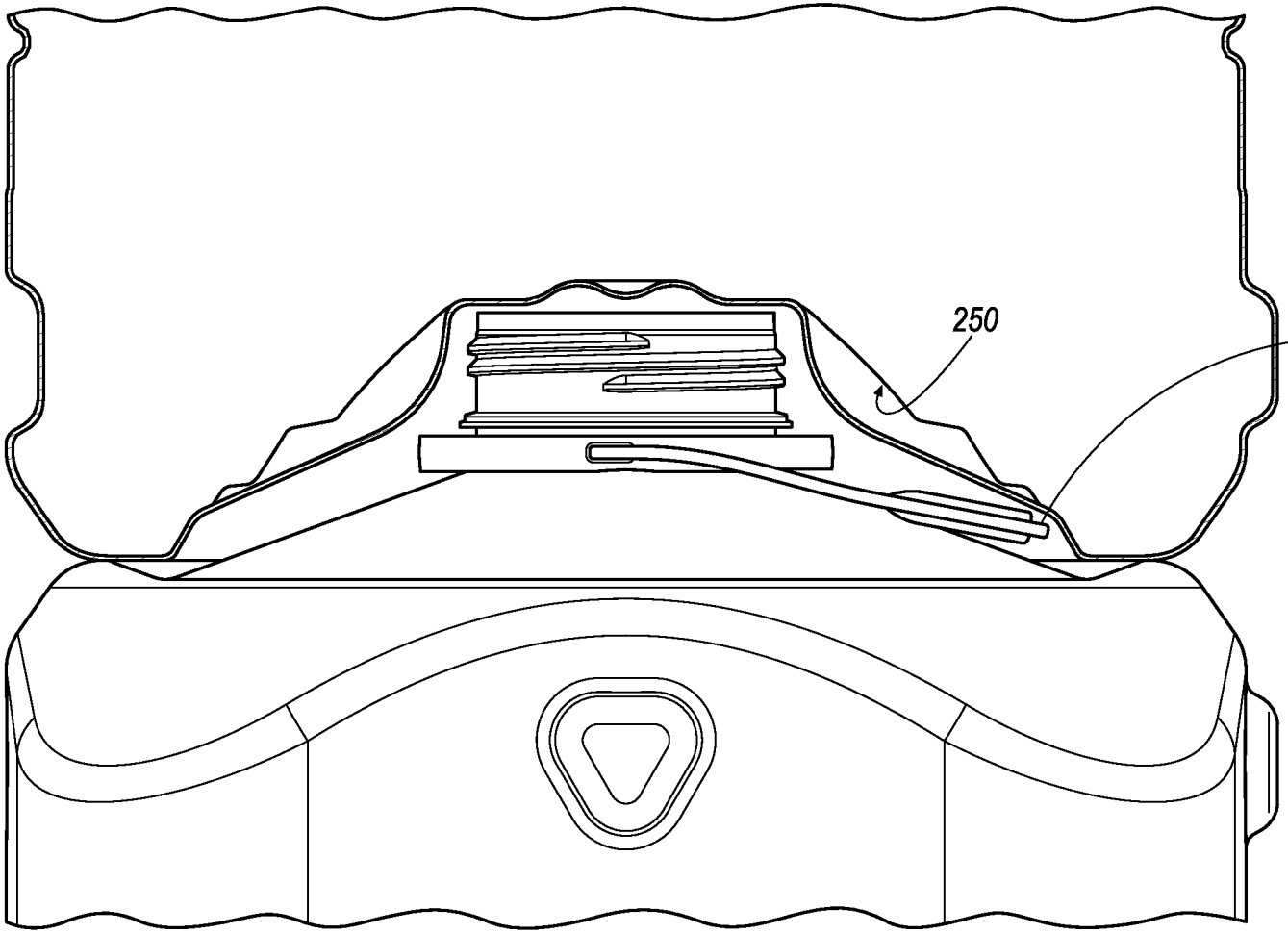
FIG. 12 is a side view of an enlarged portion of the containers shown in FIG. 10.

FIG. 9 generally illustrates an embodiment of a container 200 including a handle 210. The handle 210 may be separately formed and subsequently attached to the upper portion 40 of the container. Without limitation, the handle 210 may comprise a conventional bale handle commonly used with larger-volume plastic containers. In FIG. 10, an upper container 220 and a lower container 230 are shown in a stacked arrangement. For purposes of illustration, the lower container 230 includes a handle 210. FIGS. 11 and 12 generally illustrate isometric and side views, respectively, of an enlarged portion of the containers shown in FIG. 10. As perhaps best illustrated in FIG. 12, the handle 210 attached to the lower container 230 may be configured to fit entirely within the upwardly-extending central base portion 250 of the upper container 220. Moreover, as desired, the handle 210 may be configured so that when containers 220 and 230 are provided in a stacked configuration, the handle 210 encounters little or no top load force. In other embodiments, the containers and/or handle 210 may be configured such that a portion of the handle (e.g., the central ring-like portion of the handle 210) supports a portion of a top load force directed downwardly by an engaged portion of the base portion of the upper container 220.

Containers made in accordance with the present disclosure may be comprised of a synthetic plastic material, such as for example, polyethylene (including high density polyethylene (HDPE)), polypropylene, polycarbonate, or polyethylene terephthalate (PET), or other plastic material or plastic materials in combination, including multi-layer combinations. Additionally, embodiments of container formed in accordance with teaching of the present disclosure may have a hoop blow molded stretch ratio greater than 5.0 (for example, 5.48±0.2) and an axial blow molded stretch ratio less than about 2.5 (for example, 2.04±0.2). Moreover, in embodiments, the container may, for example and without limitation, may have an unfilled weight of about 300±6 grams, or more, and may be configured to have a content volume of 560 fluid ounces, or more. Also, in embodiments, a container filled with contents may, for example and without limitation, have a container weight to internal volume ratio that is less than 1.0 grams per fluid ounce of contents, and may be less than 0.6 grams per fluid ounce of contents.

A method for case-less stacking of plastic containers is also disclosed. In an embodiment, a first level of plastic containers including features as generally disclosed is provided. A second level of plastic containers may then be provided upon the first level of plastic containers, the weight of the second level of plastic containers creating a top load force on the first level of plastic containers. In embodiments, the collapsible formations of the first level of plastic containers may then move or deform in response to the top load force until the top load force of the top level of containers is at least partially countered by an internal hydrostatic force associated with the first level of plastic containers. The method is not limited to a specific number of levels of containers. In an embodiment, a system of stacked containers may be palletized and, optionally, may be wrapped or bound by various means known in the art.

The foregoing descriptions of specific embodiments of the present invention have been presented for purposes of illustration and description. They are not intended to be exhaustive or to limit the invention to the precise forms disclosed, and various modifications and variations are possible in light of the above teaching. The embodiments were chosen and described in order to explain the principles of the invention and its practical application, to thereby enable others skilled in the art to utilize the invention and various embodiments with various modifications as are suited to the particular use contemplated. It is intended that the scope of the invention be defined by the claims appended hereto and their equivalents.

What is claimed is:

1. A stackable plastic container for holding contents, the container comprising:

a base portion configured to support the container on a surface, the base portion including an upwardly-extending central base portion and a base reinforcement formation, a sidewall portion extending upwardly from the base portion, the sidewall portion including a sidewall reinforcement formation;

an upper portion extending upwardly from the sidewall portion, the upper portion including a shoulder portion, an angled portion, and a neck portion with a dispensing opening, the neck portion and dispensing opening being substantially centered on the upper portion of the container;

wherein the base portion is configured to withstand hydrostatic pressure; the shoulder portion includes a rounded portion and a flex portion; the flex portion is disposed between the rounded portion and the angled portion, includes a segment that extends downwardly from the rounded shoulder in the absence of a top load force, and is configured to flex downwardly substantially radially uniformly around and about a central axis of the container that extends through the dispensing opening in response to a top load force applied to the container; the central base portion is configured to receive an upper portion of another container; the vertical height of the neck portion of the upper portion of the container is greater than the vertical height of the central base portion configured to receive an upper portion of another container; in a stacked configuration, the top load force applied by the container on a neck of the another container forces the neck of the another container downwardly such that the flex portion of the another container flexes downwardly to accommodate an interference caused by the vertical height of the neck portion of the another container being greater than the vertical height of the central base portion of the container, and the total height of the stacked containers is less than twice the height of the unstacked container.

2. The container of claim 1, wherein, in a stacked configuration, the neck portion of such another container contacts the central base portion of the container.

3. The container of claim 1, wherein the neck portion of the upper portion of the container that is greater than the vertical height of the base portion includes a closure.

4. The container of claim 1, wherein, the sidewall portion is configured to accommodate internal content pressure associated with a top load force of at least 75 pounds.

5. The container of claim 1, wherein the container is configured so that in a stacked configuration, a portion of the base portion of the container contacts a shoulder portion of such another container.

6. The container of claim 5, wherein the container is configured such that when the portion of the base portion of the container contacts a shoulder portion of such another container, the central base portion of the container applies a downward force on the neck portion of such another container to cause the flex portion of the shoulder portion to flex downwardly.

7. The container of claim 1, wherein the wall thickness of the sidewall portion of the container is 0.020±0.006 in.

8. The container of claim 1, wherein the sidewall portion of the container has a generally square or rounded-square cross-section.

9. The container of claim 8, wherein the generally square or rounded-square cross-section extends substantially along an entire vertical length of the sidewall portion.

10. The container of claim 1, wherein the container is configured to have a content volume of 560 fluid ounces or more, and has a hoop blow molded stretch ratio greater than about 5.0, and an axial blow molded stretch ratio less than about 2.5.

11. The container of claim 1, wherein the sidewall reinforcement formation includes one or more ribs.

12. The container of claim 1, wherein the sidewall reinforcement formation includes one or more curved or wave-like formations.

13. The container of claim 1, wherein the sidewall includes one or more protruding formations and one or more receiving formations.

14. The container of claim 13, wherein the receiving formations are configured to interconnect or interlock with protruding formations provided on another like container.

15. The container of claim 1, wherein the base reinforcement formation includes a plurality of radially extending ribs.

16. The container of claim 1, wherein the base reinforcement formations includes one or more ring-shaped step portions.

17. The container of claim 1, wherein the container comprises polyethylene terephthalate (PET).

18. The container of claim 1, wherein the container includes contents.

19. The container of claim 18, wherein the contents comprise a liquid.

20. The container of claim 18, wherein the contents have a density that is between about 0.90 and 0.95 g/cm$^3$.

21. The container of claim 1, wherein a container is filled with contents and has a container weight to volume ratio that is less than 1.0 grams per fluid ounce of contents.

22. The container of claim 1, wherein an overall height of the container is reduced when the flex portion of the shoulder portion flexes downwardly.

23. The container of claim 1, wherein a height of the container from the base portion to a top of the shoulder portion remains substantially constant when the portion of the should portion flexes downwardly.

24. The container of claim 1, wherein the flex portion of the shoulder portion is recessed.

25. The container of claim 8, wherein the flex portion of the shoulder portion is generally annular.

26. The container of claim 13, wherein at least one of the protruding formations and/or receiving formations is at least one of generally annular and generally triangular.

27. The container of claim 1, including a separately formed handle attached to the upper portion of the container.

28. The container of claim 27, wherein the handle is configured to fit entirely within the base portion configured to receive an upper portion of another container.

29. The container of claim 27, wherein a portion of the handle is configured to support a portion of a top load force directed downwardly by another container.

30. The container of claim 1, wherein the vertical height of the neck portion of the upper portion of the container is about 0.150 inches greater than the vertical height of the central base portion configured to receive an upper portion of another container.

* * * * *